US005738455A

United States Patent [19]

Umeda

[11] Patent Number: 5,738,455

[45] Date of Patent: Apr. 14, 1998

[54] SHEET FEEDING DEVICE

[75] Inventor: Takaichiro Umeda, Nagoya, Japan

[73] Assignee: Brother Kogyo Kabushiki Kaisha, Nagoya, Japan

[21] Appl. No.: 726,409

[22] Filed: Oct. 3, 1996

[30] Foreign Application Priority Data

Oct. 3, 1995 [JP] Japan ..... 7-256435

[51] Int. Cl.[6] ..... G41J 13/076

[52] U.S. Cl. ..... 400/636; 400/638

[58] Field of Search ..... 400/636, 639, 400/638, 636.3, 634, 637, 637.1; 271/274, 273, 272

[56] References Cited

U.S. PATENT DOCUMENTS

| | | | |
|---|---|---|---|
| 1,022,766 | 4/1912 | Barnard | 400/639 |
| 4,696,592 | 9/1987 | Oka et al. | 400/636 |
| 5,275,395 | 1/1994 | Boggiano et al. | 271/274 |
| 5,540,427 | 7/1996 | Nitta et al. | 271/274 |
| 5,580,042 | 12/1996 | Taniguro et al. | 400/636.3 |

FOREIGN PATENT DOCUMENTS 2-45179 2/1990 Japan .

*Primary Examiner*—Edgar S. Burr
*Assistant Examiner*—Anthony H. Nguyen
*Attorney, Agent, or Firm*—Oliff & Berridge, P.L.C.

[57] ABSTRACT

A sheet feeding device for feeding sheets from a sheet input side to a sheet output side, the sheet feeding device comprising a rotatable sheet feed roller; a pressing roller disposed in confrontation with the sheet feed roller so that a sheet sandwiched between the pressing roller and the sheet feed roller contacts the sheet feed roller at a contact position and is fed from the sheet input side to the sheet output side by rotational force of the sheet feed roller, a tangential plane passing through the contact position dividing space between a sheet feed roller side and a pressing roller side; a reference surface disposed at the sheet output side in intersection with the tangential plane; an arm swingably supporting the pressing roller in confrontation with the sheet feed roller; and a swinging axis swingably supporting the arm and disposed at the sheet input side and at the pressing roller side.

13 Claims, 4 Drawing Sheets

SHEET FEEDING DEVICE

BACKGROUND OF THE INVENTION

1. Field of the Invention

The present invention relates to a sheet feeding device including a sheet feed roller and a pressing roller sandwiching therebetween a sheet supplied from a sheet supply side, wherein the rotational force of the sheet feed roller feeds the sheet to a sheet output side.

2. Description of the Related Art

There has been known a sheet feed roller for feeding sheets to an ink jet head of an ink jet type printer. A paper pan is disposed adjacent to the sheet feed roller and with a reference surface thereof directly in front of the ink jet head. Sheets fed from the sheet feed roller follow the reference surface to pass directly in front of the print head.

To ensure intimate contact between the reference surface and the transported sheet, that is, so that the sheet does not lift up away from the reference surface, it is necessary that sheets be fed in a direction at a slight angle with respect to the reference surface rather than parallel to the reference surface. To accomplish this, a pressing roller for sandwiching the sheet between itself and the sheet feed roller has been provided in alignment with a linear shaped guide so as to urge the paper downward against a predetermined position of the sheet feed roller. Alternatively, the pressing can be provided to the tip of a freely swingable arm and pressed against the predetermined position of the sheet feed roller by an urging force in the swinging direction of the arm. The predetermined position of the sheet feed roller is the contact position where the sheet contacts the sheet feed roller by pressing force of the pressing roller. A tangential plane passing through the contact position intersects the reference surface at a predetermined angle. Because sheets will travel in a direction parallel with the tangential plane, the sheet can be fed in any desired direction merely by adjusting the contact position and, subsequently, the tangential plane.

Because the sheet is forcibly guided in the tangential plane direction, the sheet will lift slightly away from the tangential plane by repulsion force of the sheet. However, by taking this lifting up amount into the consideration and accordingly adjusting the contact position, the sheet can be fed as desired, that is, in intimate contact with the reference surface of the paper pan without lifting up from the reference surface.

SUMMARY OF THE INVENTION

However, it is desirable that ink jet printers be capable of printing on a variety of sheets, such as postcards and envelopes, other than sheets of normal thickness. Although sheets of normal thickness can be sandwiched between the sheet feed roller and the pressing roller, and forcibly fed in a direction that intersects the reference surface at a slight angle, when a thicker sheet is to be fed, the thicker sheet produces a much stronger repulsive force when forcibly bent by the sheet feeding roller and the pressing roller to change its direction. Therefore, the amount that the thicker sheet will lift away from the reference surface will increase so that the thicker sheet cannot be satisfactory transported in intimate contact with the reference surface of the paper pan without lifting up.

It is an objective of the present invention to overcome the above described problems and provide a sheet feed device capable of transporting sheets in intimate contact with the reference surface, regardless of the sheet's thickness, by centering the swinging axis of the arm at a certain position.

To achieve these objectives, a sheet feeding device according to the present invention for feeding sheets from a sheet input side to a sheet output side, includes a rotatable sheet feed roller; a pressing roller disposed in confrontation with the sheet feed roller so that a sheet sandwiched between the pressing roller and the sheet feed roller contacts the sheet feed roller at a contact position and is fed from the sheet input side to the sheet output side by rotational force of the sheet feed roller, a tangential plane passing through the contact position dividing space between a sheet feed roller side and a pressing roller side; a reference surface disposed at the sheet output side in intersection with the tangential plane; an arm swingably supporting the pressing roller in confrontation with the sheet feed roller: and a swinging axis swingably supporting the arm and disposed at the sheet input side and at the pressing roller side.

Accordingly, the sheet feed roller and the pressing roller are disposed so that the tangential plane, which passes through the contact position where the sheet contacts the sheet feed roller when sandwiched between the sheet feed roller and the pressing roller, intersects the reference surface from above by a predetermined angle. Also, the swinging axis of the arm is disposed on the sheet supply side with respect to the contact position and on the opposite side of the tangential plane with respect the sheet feed roller.

By disposing the swing axis of the arm on the sheet supply side from the contact position, and separated from the tangential plane on the opposite side of the sheet feed roller, when a thick sheet is to be fed, the intersection angle between the tangential plane and the reference surface will increase and the tendency of the pressing roller to press the transported sheet against the reference surface will also increase, as will be described later with reference to FIG. 3.

In another words, the thicker the transported sheet, the further the pressing roller will be separated from the sheet feed roller when sandwiching the thicker sheet therebetween. However, because the swinging axis of the arm is disposed on the sheet supply side from the contact position, and also separated from the tangential plane on the opposite side of the sheet feed roller, therefore the further apart the pressing roller, that pivots about a thus-disposed swinging axis, separates from the sheet feed roller, the further the contact position is shifted toward the sheet output side. For this reason, the thicker the sheet, the greater the feed angle at which the tangential plane, passing through the contact position, intersects the reference surface.

The thicker the sheet the greater its repulsive force and the stronger its tendency to shift away from the sheet feed direction urged by the sheet feed roller and the pressing roller. However, in order to cancel out this tendency, the sheet feeding device according to the present invention is designed so that the sheets sandwiched between the sheet feed roller and the pressing roller will be strongly pressed toward the reference surface. Therefore, the sheet feeding device of the present invention can stably feed a variety of different sheets with different thicknesses without the sheets separating away from the desired sheet feed direction.

It is desirable that a guide surface be provided to the arm for guiding sheets to the contact position and that the guide surface be deformed in an indented shape curved toward the contact position. When the guide surface is shaped in this manner, when the front edge of a sheet guided by the guide surface is guided by the guide surface to be sandwiched between the sheet feed roller and the pressing roller, the shape of the sheet will conform with the shape of the guide surface and the angle at which the sheet enters the sandwiching position will be stabilized directly before the sheet feed roller and the pressing roller sandwich a sheet guided in this manner.

This weakens the tendency of the sheet to separate from the reference surface as the sheet moves toward the sheet output side from the sandwiching position. Compared to sheets entering the sandwiching position as guided by a linear or a protruding surface, the tendency to separate from the reference surface can be greatly suppressed so that intimate contact between the sheet and the reference surface can be increased and sheets can be fed more stably. The sheet feeding device of the present invention is particularly applicable to use in ink jet printers.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
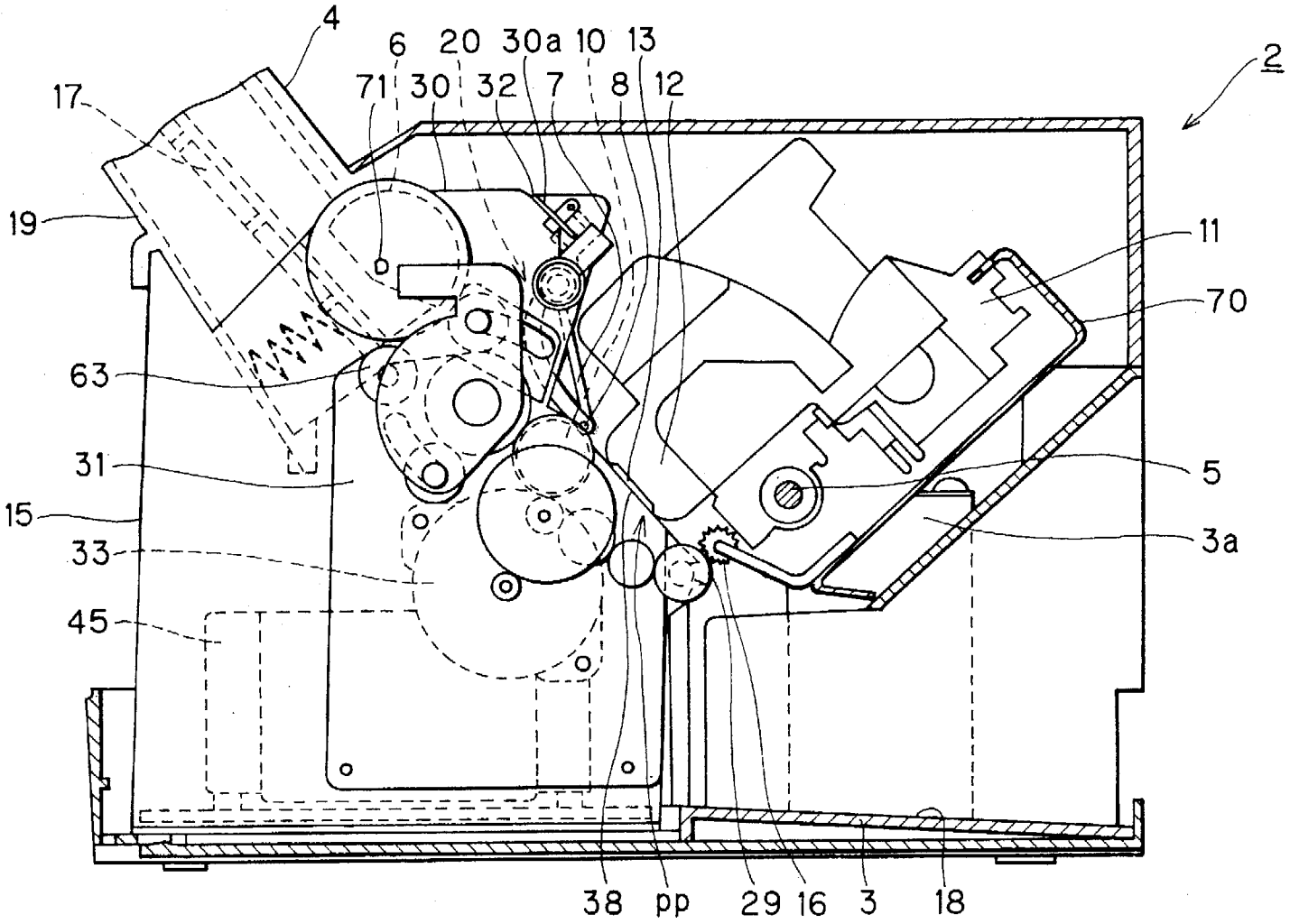
FIG. 1 is a side view in partial cross-section showing essential components of a printer including a sheet feed unit according to the present invention.

A sheet feeding device according to a preferred embodiment of the present invention will be described while referring to the accompanying drawings wherein like parts and components are designated by the same reference numerals to avoid duplicating description.

FIG. 1 is a cross-sectional view showing configuration of an ink jet printer 2 to which the sheet feeding device of the present invention has been applied. As shown in FIG. 1, an upright support portion 3*a* is provided to a base frame 3 of the ink jet printer 2. A circular-columnar shaped rail 5 and a plate-shaped rail 70, which is bent into a substantially C-shape, are fixed to the support portion 3*a*. A carriage 11 is mounted on the rails 5, 70 so as to be reciprocally movable following the rails 5, 70. An ink jet type print head 12 is mounted on the carriage 11. A resin box 15 is fixed to the upper portion of the base frame 3. The print head 12 includes an ink ejection surface 13 in confrontation with the resin box 15.

A sheet-supply cassette 19 is detachably mounted on the upper portion of the box 15. The sheet-supply cassette 19 includes a sheet-support tray 17 stacked with a plurality of cut sheets 40. A sheet-supply roller 6 formed in a substantially half-moon shape and for transporting one sheet at a time from the cut sheets 40 stacked on the sheet-support tray 17 is supported on a rotational shaft 71 at the base of the sheet-supply cassette 19. A transport roller 10 for picking up sheets 40 fed out by the sheet-supply roller 6 and transporting them into confrontation with the ink ejection surface 13 is provided near the ink ejection surface 13 along a transport pathway along which sheets 40 are transported.

As will be described in greater detail while referring to FIGS. 2 and 3, a roller holder 7 is disposed in confrontation with the transport roller 10 on the opposite side of the sheet-transport pathway. A plurality of springs 38 urges the roller holder 7 against the transport roller 10 and into pressing contact with sheets 40 transported between the roller holder 7 and the transport roller 10.

As shown in FIG. 1, a discharge roller 29 is disposed on the opposite side of the print head 12 with respect to the transport roller 10. The discharge roller 29 discharges sheets 40 with images formed thereon by the print head 12 onto a discharge tray 18 formed on the upper surface of the base frame 3. It should be noted that a guide surface for guiding sheets 40 along the sheet-transport pathway is formed on the upper surface of the box 15.

A metal plate 31 is fixed to the side surface of the box 15. A mechanism for driving the sheet-supply roller 6, the transport roller 10, and the discharge roller 29 is provided to the upper surface of the metal plate 31. A motor 33 for driving the mechanism and capable of rotating in forward and reverse directions is provided within the box 15. A power source 45 for supplying power to the motor 33 is disposed within the box 15.

Next, a sheet feed operation and a printing operation performed by the above-described configuration will be briefly described. A sheet 40, not shown in FIG. 1, transported from the sheet supply cassette 4 by the sheet supply roller 6 collides at its front edge with the pressing roller holder 7. Afterward the roller holder 7 guides the sheet between the pressing roller 8 and the sheet feed roller 10 to in front of the ink ejection surface 13, that is, at a printing position PP. Each time the sheet feed roller 10 feeds the sheet one line's distance, the carriage 11 is scanned across the sheet in a direction perpendicular to the feed direction of the sheet. The ink jet head 12 mounted on the carriage 11 ejects ink to print an ink image on the surface of the transported sheet. Afterward the sheet is sandwiched between a discharge roller 14 and a spur 16. Rotational force of the discharge roller 14 discharges the printed sheet 40 onto a discharge tray 18.

Figure 2:
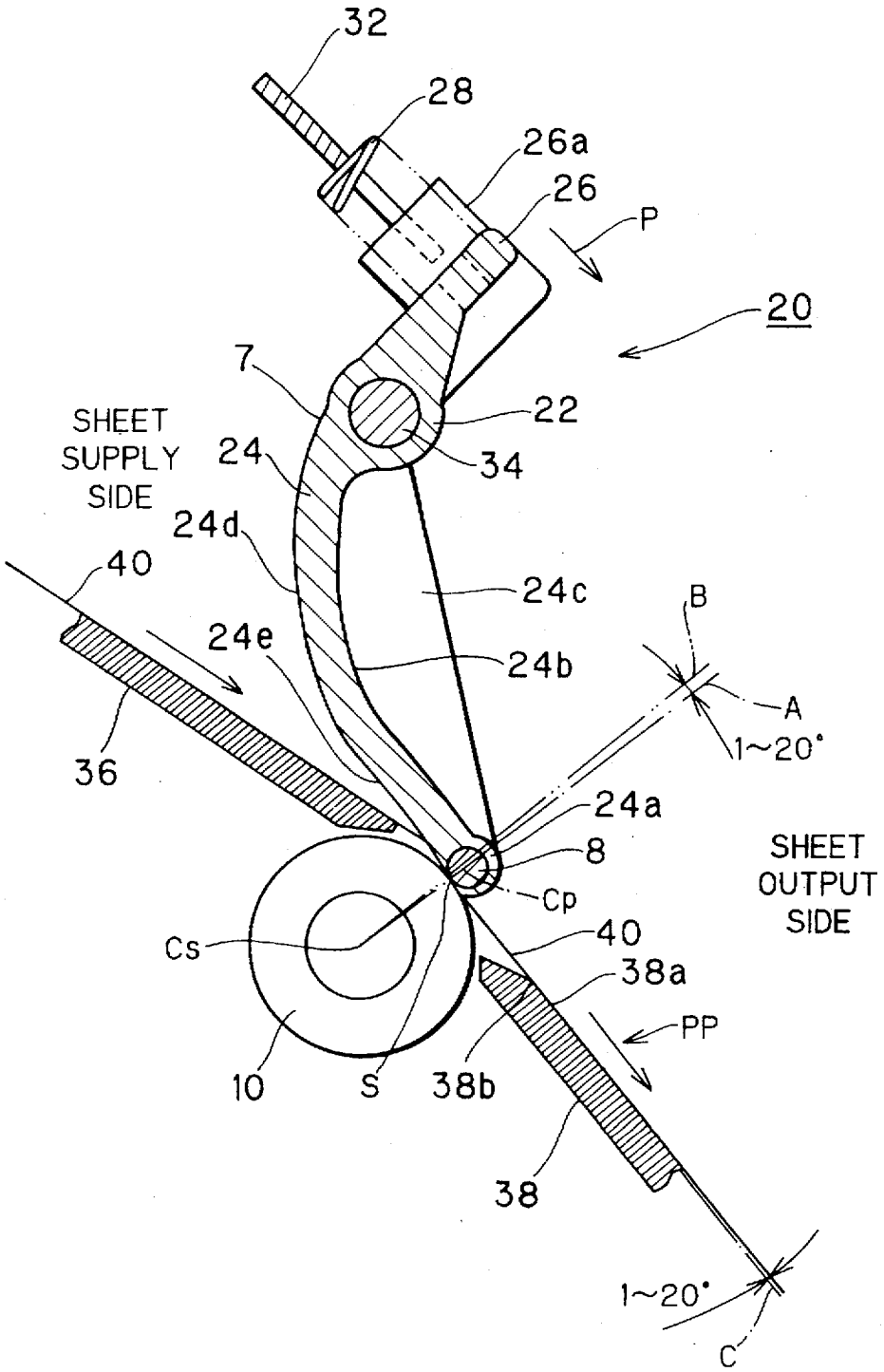
FIG. 2 is a magnified side view in partial cross-section showing the sheet feed unit according to the present invention.
Figure 3:
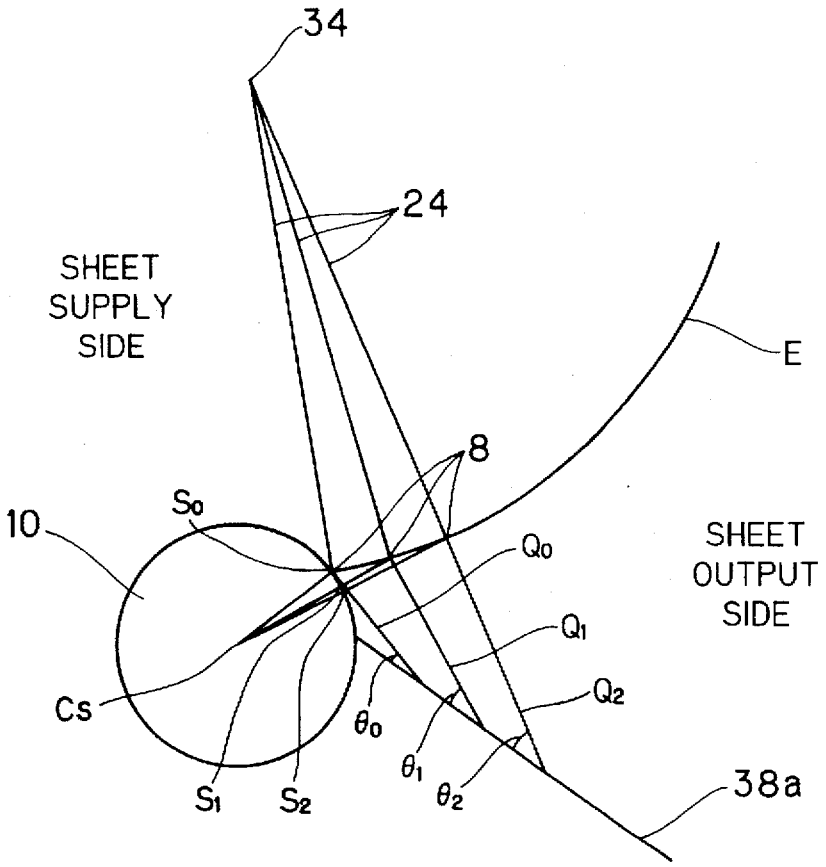
FIG. 3 is a side view schematically showing the effect that change in thickness of a print sheet has on angle between a tangential plane, passing through a contact position between a sheet and one of a sheet feed roller and a pressing roller of the sheet feed unit, and a reference surface for guiding a transported sheet to in front of a print head.

As shown in FIG. 2, the sheet feed device 20 of the present embodiment includes the roller holder 7, the pressing roller 8, and the sheet feed roller 10. The roller holder 7 has an elongated arm shape and includes in order, starting from the upper part of FIG. 2, a spring receiving plate 26; a bearing portion 22 integrally connected to the spring receiving plate 26 and swingably supported on a shaft 34; a curved guide plate 24 extending from the bearing portion 22 on the opposite side from the spring receiving plate 26; and a bearing portion 24*a* formed to the tip of the curved guide plate 24 and rotatably supporting the pressing roller 8. A plurality of ribs 24*c* for reinforcing the curved guide plate 24 are formed in a concave surface 24*b* of the curved guide plate 24.

A plurality of cylindrical spring bearing portions 26*a*, each with a spring 26*a* mounted therein, is provided to the spring receiving plate 26. As shown in FIG. 1, a groove 30*a* is formed between two confronting pieces of a frame 30 positioned in confrontation each other in the ink jet printer 2. A spring support plate 32 is fixed with both edges inserted in the groove 30*a*. The springs 28 are disposed in a compressed condition between the spring receiving plate 26 and the spring support plate 32. As a result, the spring receiving plate 26 is urged by the springs 28 in a direction indicated by arrow P in FIG. 2.

The roller holder 7 is supported swingably by an axis 34 spanning between two parts of the frame 30. Therefore, the pressing roller 8, which is at a tip of the curved guide plate 24 on the opposite side of the bearing portion 22 with respect to the spring receiving plate 26, is pressed against the peripheral surface of the sheet roller 10 by the moment generated by repulsive force of the springs 28. The pressing roller 8 presses a sheet 40 sandwiched between itself and the sheet feed roller 10 at a contact position S. Alternatively, the contact position S can be defined as the position where the sheet 40 contacts the pressing roller 8. The side of the contact position S at which are disposed the sheet supply cassette 4 and the sheet supply roller 6 will be referred to as the sheet supply side hereinafter. The opposite side of the contact position S at which are disposed the print head 12 and the discharge roller 29 will be referred to as the sheet output side hereinafter. A tangential plane C passes through the outer peripheral surface of the sheet feed roller 10 at the contact position S. Alternatively, the tangential plane C can be defined as a tangential plane passing through the outer peripheral surface of the pressing roller 8 at the contact position S.

A first paper pan 36 is disposed to the sheet supply side from the contact position S. The paper pan 36 supports from below a sheet 40 transported by the sheet supply roller 6 and guides the sheet 40 toward the contact position S. Further, a second paper pan 38 with a reference surface 38*a* is provided at the printing position PP toward the sheet output side from the contact position S. The second paper pan 38 supports from below on its reference surface 38*a* the sheet 40 transported toward the sheet output side from the contact position S and positions the sheet 40 as required for printing.

A rotational center Cp of the pressing roller 8, the contact position S, and a rotational center Cs of the sheet feed roller 10 are aligned on a line A. The line A forms an acute angle with respect to the reference surface 38*a*. In the present embodiment, the angle between line A and the reference surface 38*a* is from 70 to 89 degrees, that is, 1 to 20 degrees less than a perpendicular angle. An edge 38*b* of the reference surface 38*a* is disposed closer to the sheet feed roller 10 than to the tangential plane C. Because the reference surface 38*a* is slanted downward in this manner, the tangential plane C intersects the reference surface 38*a* from above by a predetermined angular amount.

The sheet 40 transported from the contact position S is fed substantially following the tangential plane assisted by operation of an indented guide surface 24*e* to be described later. Accordingly, the front edge of a sheet 40 contacts the reference surface 38*a* at the predetermined angle of, for example, between 1 and 20 degrees. Afterwards, the front edge of the sheet 40 is transported following the reference surface 38*a*. The sheet 40 is transported with its under surface in intimate contact with the reference surface 38*a*. For this reason, the upper surface of the sheet 40 will be disposed at the appropriate printing position PP for printing so that printing can be performed with high precision.

Because the pressing roller 8 is supported by the roller holder 7, which is disposed to the sheet supply side from the contact position S, the roller holder 7 itself can be disposed separated from the printing position PP by an appropriate gap and also the ink jet head 12 and other relevant components can be disposed in the vicinity of the printing position PP with high density. Therefore, the ink jet printer 2 can be produced in a compact size.

The shaft 34, which serves as the swinging axis of the roller holder 7, is disposed on sheet supply side from the contact position S and separated from the tangential plane at a side thereof opposite the sheet feed roller 10. As shown schematically in FIG. 3, the thicker the sheet 40 (within limits useable in the ink jet printer), the further the pressing roller 8 separates from the sheet feed roller 10. Therefore, the curved guide plate 24 rotates leftward, that is, counter-clockwise as viewed in FIG. 3, so that the pressing roller 8 follows curve E and the contact position S, that is, the position where the sheet 40 contacts the sheet feed roller 10 or the pressing roller 8 when sandwiched between the sheet feed roller 10 and the pressing roller 8, gradually moves toward sheet output side as indicated by contact positions S0, S1, S2. The corresponding tangential planes Q0, Q1, Q2 passing through respective contact positions S0, S1, S2 intersect the reference surface 38*a* at increasingly large intersecting angles θ0, θ1, θ2. With this configuration the thicker the sheet 40, the more strongly it is pressed against the reference surface 38*a*.

On the other hand, because thicker sheets 40 have a greater repulsion force, and do not easily follow the curved guide surface 24*e*, the thicker the sheet 40, the greater the tendency of the sheet 40 to shift from the direction of sheet feed intended by the sheet feed roller 10 and the pressing roller 8. That is to say, the thicker the sheet 40, the more likely it will to lift up from the reference surface 38*a*.

However, with the above-described configuration, even if the sheet 40*a* is comparatively thick, the tendency for it to press against the reference surface 38*a* and the tendency for it to lift away from the reference surface 38*a* will cancel each other out so that the sheet 40 can be stably transported. The printing position PP can be stably maintained so that high quality printing can be obtained.

It should be noted that the curved guide plate 24 has at its sheet supply side surface a guide surface 24*d* formed in an overall protruding shape curving from the bearing portion 22 toward the contact position S, thereby acting to guide sheets 40 toward the contact position S. An indented guide surface 24*e* is formed near the tip of the guide surface 24*d*, that is, at the portion of the guide surface 34*d* directly before the contact position S on the sheet supply side. The indented guide surface 24*e* curves in the opposite direction of the guide surface 24*d* and has a shape arched in the direction in which sheets 40 are to be guided. Said differently, the indented guide surface 24*e* is formed so that, when viewed in cross section from the direction of sheet feed, the center of curvature for the arc-shaped indented guide surface 24*e* is located on the sheet feed roller 10 side of the curved guide plate 24 rather than on the rib 24*c* side. In the present embodiment, the center of curvature for the indented guide 24*e* is on one side (i.e. the sheet feed roller 10 side) of the tangential plane and the center of curvature of the guide surface 24*d* is on an opposite side (i.e. the pressing roller 8 side).

The front edge of sheets 40 guided to the sheet supply side edge of the guide surface 24*d* will conform to the shape of the indented guide 24*e* and be accurately guided between the sheet feed roller 10 and the pressing roller 8. In this way, directly before the sheet 40 is sandwiched between the sheet feed roller 10 and the pressing roller 8, because the sheet 40 conforms to the curved shape in the direction it is indented to be guided, the angle at which the sheet 40 enters the contact position S is more stable and the tendency for the sheet 40 to separate from the reference surface 38*a* is reduced. Compared to when a sheet 40 enters the contact position S by a linear or an outwardly protruding shape, the tendency to separate from the reference surface 38*a* is suppressed and the tendency to move in intimate contact with the reference surface 38*a* is increased, thereby enabling high precision printing.

Figure 4:
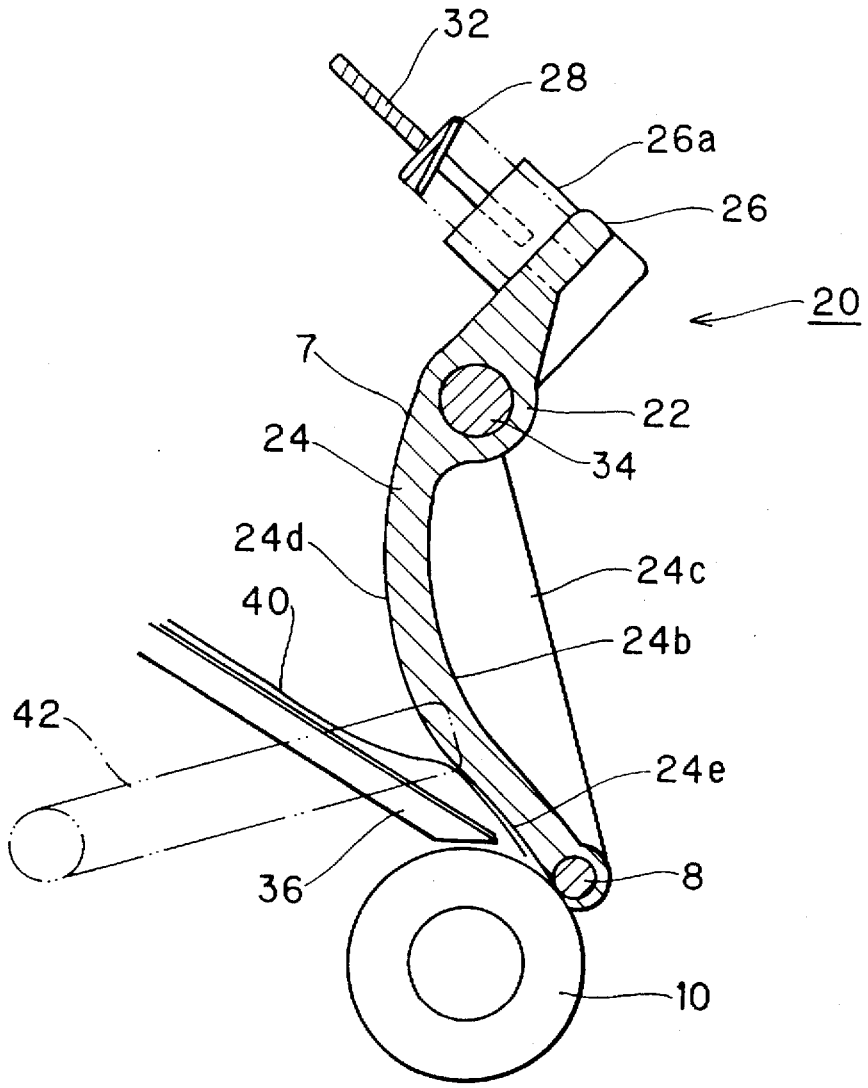
FIG. 4 is a side view in partial cross-section showing a guide surface of the present invention correcting path of a sheet misdirected by peripheral components.

As shown FIG. 4, peripheral components, such as a sensor lever 42 for detecting the presence of the sheet 40, can contact the front edge of the sheet 40 and lift the sheet 40 up from the surface of the first paper pan 36 so that the front edge of the sheet 40 collides with the guide surface 24*d* of the curved guide plate 24 at an abnormally large angle. However, the indented guide surface 24*e* smoothly guides the front edge of the sheet 40 back toward the contact position S. Therefore, sheets 40 are not easily caught on the curved guide plate 24 so that jams can be prevented.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A sheet feeding device for feeding sheets from a sheet input side to a sheet output side, the sheet feeding device comprising:

a rotatable sheet feed roller;

a pressing roller disposed in confrontation with the sheet feed roller so that a sheet sandwiched between the pressing roller and the sheet feed roller contacts the sheet feed roller at a contact position and is fed from the sheet input side to the sheet output side by rotational force of the sheet feed roller, a tangential plane passing through the contact position dividing space between a sheet feed roller side and a pressing roller side;

a reference surface disposed at the sheet output side in intersection with the tangential plane;

an arm swingably supporting the pressing roller in confrontation with the sheet feed roller, wherein the arm is provided with a guide surface for guiding sheets to the contact position;

a swinging axis swingably supporting the arm and disposed at the sheet input side and at the pressing roller side; and a support member forming a sheet transport pathway, wherein the support member includes a tip portion facing the sheet feed roller, the support member is disposed on the sheet supply side of the contact position so that an imaginary line extending from the tip portion of the support member and parallel to the support member intersects the guide surface of the arm.

2. A sheet feeding device as claimed in claim 1, wherein the guide surface is formed in a curved shape that smoothly curves towards the contact position.

3. A sheet feeding device as claimed in claim 1, wherein the guide surface includes a first curved guide surface adjacent to the pressing roller and with a center of curvature disposed on a same side of the arm as the sheet feed roller.

4. A sheet feeding device as claimed in claim 3, wherein the guide surface includes a second curved guide surface curving from the swinging axis toward the contact position and with a center of curvature disposed on an opposite side of the arm than the sheet feed roller.

5. A sheet feeding device as claimed in claim 4, wherein the pressing roller and the sheet feed roller are disposed so that their rotational axes and the contact position are aligned along a plane intersecting the reference surface at an acute angle.

6. A sheet feeding device as claimed in claim 5, wherein the plane intersects the reference surface at a 70 to 89 degree angle.

7. A sheet-supply device as claimed in claim 6, further comprising a printing mechanism including:

a print head for printing images on sheets; and a carriage supporting and transporting the print head in confrontation with the reference surface.

8. A sheet feeding device as claimed in claim 1, wherein the guide surface includes a first curved guide surface adjacent to the pressing roller and with a center of curvature disposed at the sheet feed roller side.

9. A sheet feeding device as claimed in claim 8, wherein the guide surface includes a second curved guide surface curving from the swinging axis toward the contact position and with a center of curvature disposed at the pressing roller side.

10. A sheet feeding device as claimed in claim 1, wherein the pressing roller and the sheet feed roller are disposed so that their rotational axes and the contact position are aligned along a plane intersecting the reference surface at an acute angle.

11. A sheet feeding device as claimed in claim 10, wherein the plane intersects the reference surface at a 70 to 89 degree angle.

12. A sheet-supply device as claimed in claim 1, further comprising a printing mechanism including:

a print head for printing images on a sheet; and a carriage supporting and transporting the print head in confrontation with the reference surface.

13. A sheet forming device as claimed in claim 1, wherein the arm is formed with a sheet abutment portion against which supplied sheets abut, the abutment portion being disposed on the sheet input side of the contact position.

* * * * *